US005810564A

United States Patent [19]

Kakovitch

[11] Patent Number: 5,810,564

[45] Date of Patent: Sep. 22, 1998

[54] METHOD AND APPARATUS FOR IMPROVEMENT IN THE EFFICIENCY OF EVACUATION AND COMPESSION OF FLUIDS

[76] Inventor: Thomas Kakovitch, 2720 Fox Mill Rd., Herndon, Va. 22071

[21] Appl. No.: 829,940

[22] Filed: Apr. 1, 1997

[51] Int. Cl.[6] ..... F04B 19/204

[52] U.S. Cl. ..... 417/207

[58] Field of Search ..... 417/207

[56] References Cited

U.S. PATENT DOCUMENTS 2,343,665 3/1944 Hickman ..... 417/207

2,379,151 6/1945 Hickman ..... 417/207

*Primary Examiner*—Timothy Thorpe

*Assistant Examiner*—Cheryl J. Tyler

*Attorney, Agent, or Firm*—Dennison, Meserole, Pollack & Scheiner

[57] ABSTRACT

An apparatus and method for evacuating gas from a chamber to reduce the pressure therein utilizes a housing having a lower, downwardly facing wall and an upper, upwardly facing wall, a first gas flow director of truncated conical shape having a larger end facing downwardly and a smaller end facing upwardly and disposed within the housing coupled to the lower wall. A plurality of stationary vanes is disposed adjacent the smaller end of the first gas flow director, for imparting a vortex flow to gas flowing therethrough. A second gas flow director of truncated conical shape and having a larger end facing downwardly and disposed within the housing and a smaller end facing upwardly is coupled to the upper wall, the surface of the second gas flow director within the housing including a plurality of longitudinal slits, each slit including outer and inner guide flaps to guide the flow of gas through the slit. The larger end of the second gas flow director is closed and gas deflected towards the slits, and the gas is heated within the second gas director to increase the flow of gas. Gas flows upwardly through the first gas flow director, the slits and the second gas flow director to an outlet.

7 Claims, 3 Drawing Sheets

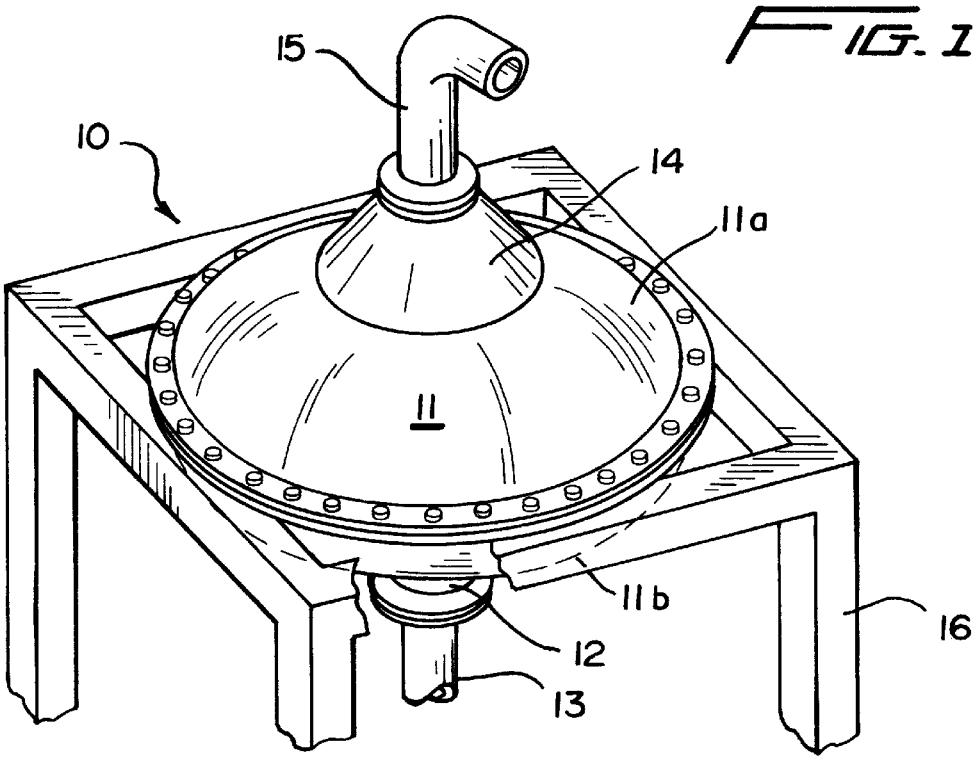
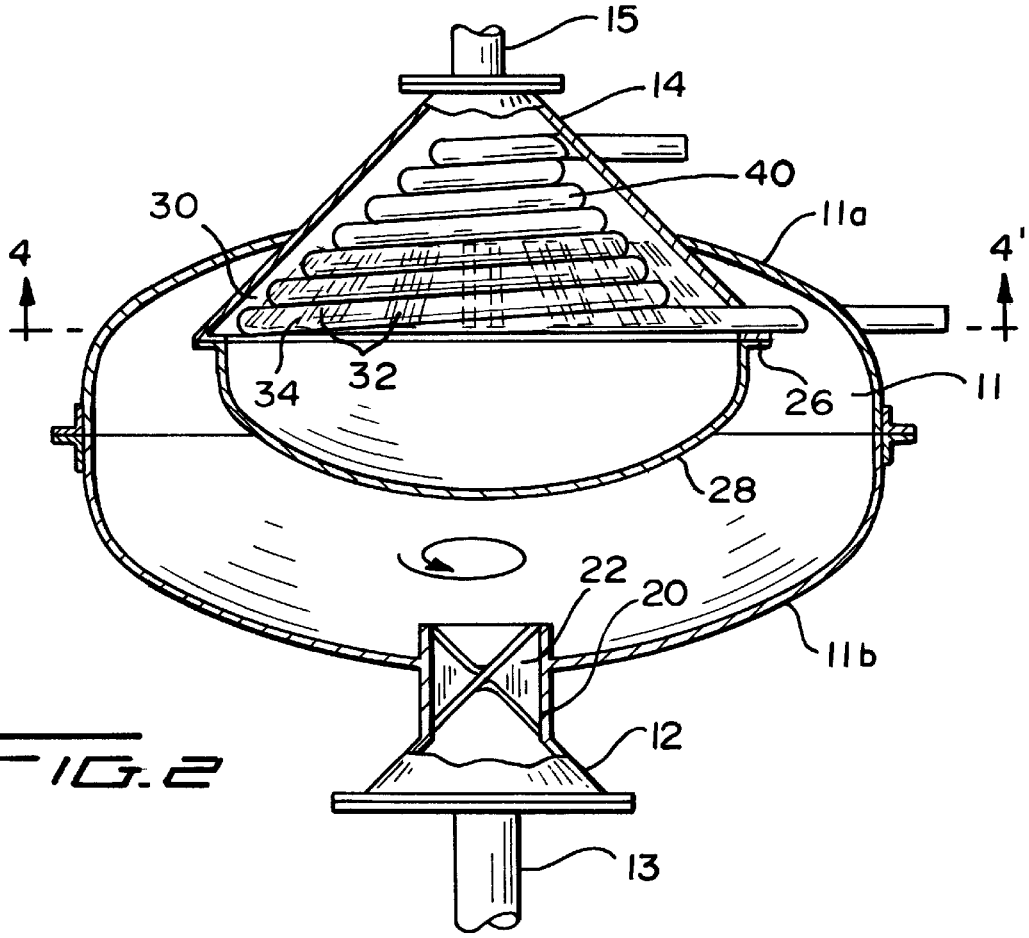
FIG. 2

METHOD AND APPARATUS FOR IMPROVEMENT IN THE EFFICIENCY OF EVACUATION AND COMPESSION OF FLUIDS

BACKGROUND OF THE INVENTION

The invention relates to the field of evacuating gases from chambers to produce reduced pressures therein, and in particular to improvements in apparatus known as generally as vacuum pumps, as well as improvements in gas compressors.

In order to reduce the pressure in a chamber, it is well known to use a fan, compressor or other type of gas movement device to blow the gas in the chamber outwardly. The efficiency of such a device lasts only so long as there is gas in the chamber to be evacuated, since the gas assists in turning the fan blades, and reduces the amount of electrical power which must be used to operate the fan. When the pressure in the chamber has been reduced, there is less gas being moved to turn the fan blades, so more electrical power must be applied to the fan to move the blades. The reduction in efficiency at reduced pressures is considerable, and requires the use of a fan sized to be effective at reduced pressure.

Applicant has experienced the difficulties resulting from evacuating a chamber as the pressure is reduced in conjunction with operation of the power generation system disclosed in U.S. Pat. No. 5,444,981, incorporated herein by reference. In the closed system disclosed in that patent, a light, non-condensable gas, typically helium, is added to a working fluid, typically water, in a boiler. The working fluid is vaporized in the boiler, and the mixture of light gas and vaporized working fluid is used to operate a turbine to generate electric power. The light gas and working fluid mixture is then passed to a condenser to separate the working fluid from the light non-condensable gas, and the gas and working fluid are separately returned to the boiler.

As part of the cycle disclosed in that patent, a portion of the light gas may be returned to the boiler by way of aspiration by the working fluid or may be returned separately. Additionally, a compressor may be used to return the light gas to the boiler at high pressure.

In seeking to improve the process disclosed in the patent, applicant has used a fan to evacuate the light gas from the condenser, and pass it on to a compressor. However, applicant has noted the decrease in efficiency of the fan as pressure is reduced in the condenser, and a larger, more powerful fan must be used to maintain proper flow of light gas to the compressor.

SUMMARY OF THE INVENTION

It is therefore an object of the invention to provide a means for increasing the efficiency of a gas evacuating device as the pressure of gas in a chamber being evacuated is reduced.

It is a further object of the invention to improve the process disclosed in U.S. Pat. No. 5,444,981 by more efficiently returning the light gas to the boiler.

These and other objects of the invention are achieved with an apparatus referred to hereinafter as a "vortex pump," a non-adiabatic, steady-state gas moving device, utilizing a truncated cone, the gas flow being maintained without moving parts, by creating vortex flow.

The apparatus of the invention thus comprises a housing having a lower, downwardly facing wall and an upper, upwardly facing wall, an inlet disposed within the lower wall and comprising a first gas flow director of truncated conical shape having a larger open end facing downwardly and a smaller open end facing upwardly, in flow communication with the housing. A plurality of stationary vanes is disposed at the smaller open end of the first gas flow director, for imparting a vortex flow to gas flowing therethrough.

An outlet is disposed within the upper wall of the housing comprising a second gas flow director of truncated conical shape and having a larger end facing downwardly and disposed within the housing and a smaller open end facing upwardly, external to the housing, the second gas flow director further comprising a circumferential surface portion disposed within the housing. The surface portion comprises outer and inner surfaces, and a means for closing the larger end of said second gas flow director, to prevent flow of gas therethrough. A plurality of slits is disposed longitudinally in this surface portion of the second gas flow director, each slit comprising a guide flap disposed on the outer surface and a guide flap disposed on the inner surface for guiding gas flow through the slit.

A heating device is disposed within the second gas flow director and a deflector is disposed within the housing adjacent the means for closing to direct gas flow away from the means for closing and towards the outer surface of the circumferential surface portion.

In the method for using this apparatus, the gas in the outlet is heated by the heating device to a temperature at least about 16° C. above ambient to increase gas flow through the device.

In order to maximize the efficiency of the gas moving device, three velocities of gas flow through the cone must be defined and equated. The three velocities are:

1) A steady state velocity of gas entering through the area of the inlet into the cone, and defined as slit velocity, $$V_{slit} = \frac{\text{Capacity}}{A}$$

2) A velocity associated with the vorticity of gas within the cone, and defined as vortex velocity $$V_{vortex} = \frac{P\Delta t}{2\pi h\rho}$$

3) A velocity associated with dynamic pressure created inside the cone, and defined as dynamic velocity $$V_{dyn}=\sqrt{[2(H-P)/\rho]}$$

In these equations, A is the area of the opening, capacity is the gas moving capacity of the gas moving device, for example in cubic feet per minute, h is the radius of the housing at a given point, H is total pressure, P is static pressure, ρ is the density of the gas being moved and Δt is the residence time of gas in the cone.

By using temperature differential rather than a gas moving device to move the gas and by creating a tangential gas flow and thereby a vortex flow through the housing, it is possible to reduce the resistance to flow created by a gas moving device, and thereby improve the efficiency of gas flow. However, in order to maximize the improvement in efficiency, values for A and h should be selected such that:

$$V_{slit}=V_{vortex}=V_{dyn}$$

h being the radius of the housing at the opening of area A tangential to the inner wall of the housing. Since slit capacity, static pressure P, vortex impulse PΔt, total pressure H and gas density ρ can be easily calculated, it is possible to equate the above equations to located values of A and h consistent with identical values for slit, vortex and dynamic velocities.

Vortex velocity is calculated by the Biot and Savart Law $V_{vortex}=\Pi/2\pi h$, where $\Pi=P\Delta t/\rho$ and by combining these equations, it is calculated that $V_{vortex}=P\Delta t/2\pi h\rho$.

Slit velocity is calculated at an opening of area A by the law of conservation of mass such that $V_{slit}$=capacity/A.

Dynamic velocity is calculated from the equation stating that total pressure is equal to dynamic pressure plus static pressure. Since dynamic pressure is known to be $0.5\rho(V_{dyn})^2$, it is therefore known that $0.5\rho(V_{dyn})^2+P=H$, and consequently $V_{dyn}=\sqrt{[2(H-P)/\rho]}$.

By equating the velocities, one obtains: $P\Delta t/2\pi h\rho=\sqrt{[2(H-P)/\rho]}$=capacity/A. From the known quantities, it is possible to calculate the area of the opening A=capacity/$\sqrt{[2(H-P)/\rho]}$, and then to calculate the ratio of $\Delta t/h=(2\pi\rho)$ capacity/PA. Knowing the ratio Δt/h, it is then possible to calculate vortex velocity $V_{vortex}=P\Delta t/2\pi h\rho$, and to calculate h for a given Δt.

BRIEF DESCRIPTION OF THE DRAWINGS

FIG. 1 is a longitudinal plan view of a housing according to the invention;

FIG. 2 is a longitudinal cross-sectional view of the housing shown in FIG. 1;

DESCRIPTION OF THE PREFERRED EMBODIMENTS

Figure 3:
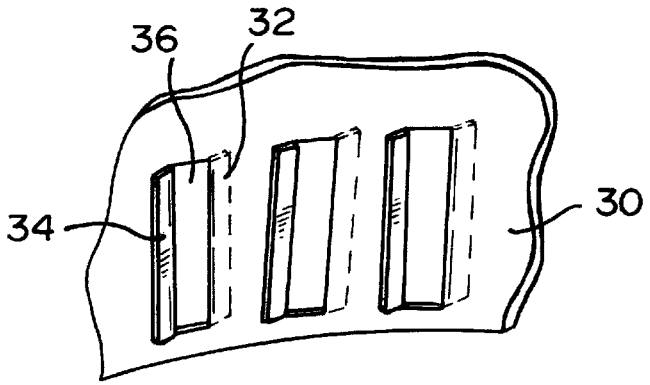
FIG. 3 is an exploded cut-away view of a portion of the surface of the slotted, truncated cone shown in FIG. 2.

FIG. 1 shows the external appearance of an apparatus for evacuating a chamber according to the invention. The apparatus 10 includes a housing 11 having a "elliptical" shape, having a lower wall 11*b* and upper wall 11*a*. Disposed in the lower wall 11*b* is a conical portion 12 of truncated conical shape (hereinafter cone 12) leading to an inlet 13 and disposed in the upper wall 11*a* is an upper conical portion 14 of truncated conical shape (hereinafter cone 14) leading to an outlet 15. Cones 12 and 14 both serve as gas flow directors. The entire apparatus may be supported by legs 16.

FIG. 2, showing the apparatus of FIG. 1 in cross-section, shows that inlet 13 is open to housing 11 to permit gas to flow through cone 12 and into the housing. Deflection vanes 22 are disposed at the smaller, inside end 20 of lower conical portion 12, the figure showing an apparatus with four deflection vanes spaced at 90°. A greater number of vanes could also be used, such as five vanes spaced at 72°, six vanes spaced at 60° or eight vanes spaced at 45°.

The housing 11 is disposed such that the flow of gas is generally upwardly, with the vanes 22 deflecting the gas to initiate vortex flow. However, the general direction of gas flow within housing 11 is still generally upwardly, in the direction of the arrow.

At the upper end of housing 11, opposite to the inlet, there is disposed a larger truncated cone 14 serving to direct gas to outlet 15. The larger, inner end of cone 14 is not open; it is blocked by a closure 26. Moreover, the upwardly rising gas is generally prevented from contacting closure 26 by a generally semi-spherical deflector 28; a conical deflector could also be used. The deflector 28 guides the flow of gas to a surface portion 30 of cone 14 located within the housing 11. This surface portion 30 has a plurality of slits 32 therethrough, the slits admitting gas to the interior portion of the cone 14. The flow of gas through slits 32 is a vortex flow, substantially tangential to the outer surface 30. Adjacent each slit 32 is a flap 34, best shown in FIG. 3, attached to the outer surface 30 and which serves as a guide for gas entering the slit, the flap being attached to the outer surface along a line at which gas is intended to enter the slit.

A corresponding flap 36 is located inside the cone, attached to the inner surface 38 along a line at which gas exits the slit, and disposed in the intended direction of gas flow.

Each slit and flap can be constructed by cutting a slit into the cone and attaching corresponding flaps, such as by welding. Alternatively, each slit can be constructed by making parallel cuts in the surface of the cone, and making a perpendicular cut midway in the length of surface between the parallel cuts, to create two portions. One portion is then pushed inwardly to create an inner flap, and the other portion is pushed outwardly to create an outer flap.

Figure 4:
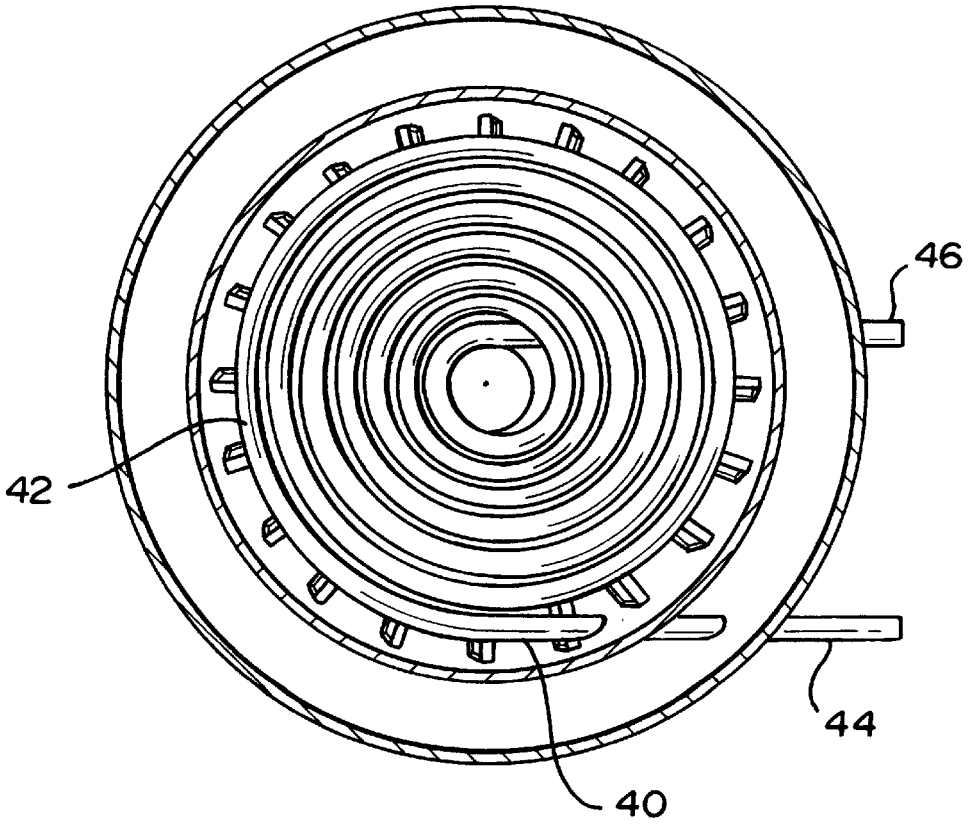
FIG. 4 is a plan view of the inside portion of the slotted truncated cone shown in FIG. 2, along line 4-4'.

Also disposed within the cone 14 is a heating device 40. Heating device 40 is disposed internally of the slitted inner surface 38, so as to not interfere with the flow of gas through cone 14 to the outlet 15. The heating device can be, as shown in FIGS. 2 and 4, a metal coil having an inlet 44 and outlet 46 through which steam or hot water is pumped, and this is preferred when the vortex pump is used in conjunction with a power plant which has a ready supply of steam and hot water. Alternatively, other heating devices could be used, such as electrical coils, microwave or other electromagnetic heating system, such as laser. The purpose of the heating device is to create a temperature differential between the inlet and the outlet of the vortex pump, to increase the upward flow of gas. While no specific temperature is required to be maintained at the interior of the cone 14, the temperature should be at least about 16° C. greater than ambient temperature in the vicinity of the vortex pump. Thus, if the temperature in the vicinity of the pump is 40° C., the temperature within cone 14 should be maintained at at least 56° C.

Typically, it is advantageous to maintain the interior of cone 14 at much greater temperatures in order to increase gas flow. The superheated steam present in power plants can raise the temperature in cone 14 as high as 425° C., and temperatures in this range are usually preferred.

Figure 5:
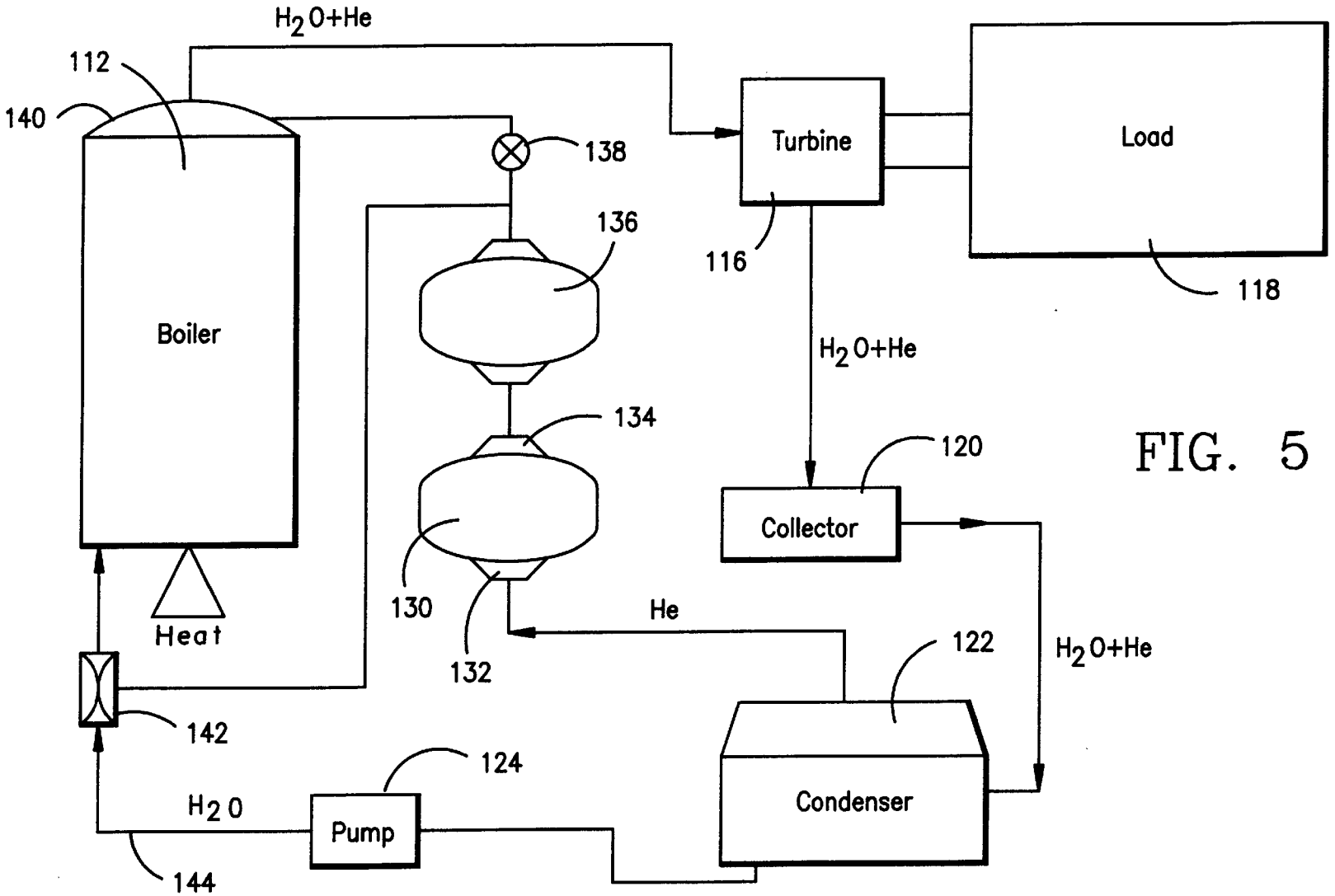
FIG. 5 is a schematic diagram of a power generating apparatus of U.S. Pat. No. 5,444,981, utilizing the housing of the invention.

The apparatus of the invention can be used in conjunction with a power generation cycle, for example the cycle disclosed in U.S. Pat. No. 5,444,981, and shown in FIG. 5. The cycle includes a boiler 112 heating a working fluid of water and helium which is used to drive a turbine 116, operating a load 118. After driving the turbine, the cooled working fluid is collected in collector 120 and separated in condenser 122. Water from the condenser is recycled to the boiler by pump 124.

In order to better remove helium from the condenser, vortex pump 130 is used to evacuate the helium. The lower portion of vortex pump 130 is coupled to the condenser by inlet 132 according to the invention. Helium is removed from the condenser through outlet 134 and passed to another vortex pump 136 serving as a first compressor. Helium removed from vortex pump 136 can be passed to a standard compressor 138, and returned to the dome 140 of the boiler. Alternatively, or in addition, helium removed from vortex pump 136 can be directed to a venturi 142 in boiler feedwater line 144, to return water and helium to the boiler.

The capacity of the vortex pump will depend upon its size, and particularly, the size of the outlet cone. Thus, an outlet cone having a maximum diameter of 60" will have a gas moving capacity of about 20,000 CFM in a housing about 72" in diameter. A cone of 108" diameter will have a capacity of about 60,000 CFM and a cone of diameter of 204" will have a capacity of about 200,000 CFM.

The apparatus of the invention will typically be constructed from steel, but can be constructed from any metal having the necessary strength and corrosion and heat resistance, or could be constructed from a polymer having these properties.

It is important that the heat exchange portion of the apparatus be constructed of a material which is highly heat conducting, such as copper.

EXAMPLE

A steel housing is constructed with a diameter of 58.3125". An inlet cone in the bottom wall of the container has an inlet diameter of 16", tapering to 8" at the entrance to the housing. Four stationary vanes at 90° are placed at the inlet. At the opposite end of the housing there is an outlet cone of diameter 39", tapering to 6" at the upper outlet. The larger end of the cone is closed off, and blocked by a semispherical deflector.

The outer surface of the outlet cone within the housing has 20 longitudinal slits evenly spaced around the circumference. These slits are 8" in length and 0.09" in width. Perpendicular guide flaps attached to the outer and inner cone surfaces are 3" in width.

A 35' coil of copper tubing of inner radius ($r_i$) 0.625" and outer radius ($r_o$) 0.75" is placed in the outlet cone. Steam enters the coil at 800° F. (427° C.) and a velocity of 3319.23 ft/sec, and exits the coil at 570° F. (299° C.) and a velocity of 1615.36 ft/sec.

The power removed from the steam in the coil is 295.377 HP.

If it is assumed that heat is transferred through the coil in a radial direction only to the helium, which absorbs heat through convection, the only space coordinates needed to define the system are the radius r and tube length L. Fourier's law can then be used to calculate the heat flow in the system.

The area for heat flow in a cylindrical system is $$A_r = 2\pi r L$$

so that Fourier's law is written $$q_r = -kA_r \cdot \frac{dT}{dr}$$

or $$q_r = -2\pi kL \cdot \frac{dT}{dr}$$

within the boundary conditions $T=T_i$ at $r=r_i$ and $T=T_o$ at $r=r=r_o$. The solution to this equation is $$q = \frac{2\pi kL(T_i - T_o)}{\ln(r_o/r_i)}$$

In the course of the process, the helium is heated to 620° F. (327° C.). The amount of heat absorbed by the helium can be calculated from the Nusselt number, the Reynolds number and the Prandtl number:

$$Re = \frac{\vec{V} \times 2 \times Ro}{12 \times V}$$

$$Pr = \frac{Cp \times m \times 3600}{k}$$

$$Nu = 0.023 \times Re^{0.8} \times Pr^{0.4}$$

$$CH = \frac{Nu \times K \times 12}{2Ro}$$

$$EH = \pi \times CH \times \frac{2Ro}{12} \times (T_W - T_B)L$$

where:

Re=Reynolds Number

Pr=Prandtl Number

Nu=Nusselt Number $\vec{V}$=gas velocity

V=gas kinematic viscosity m=gas viscosity

Cp=specific heat of gas at constant pressure k=gas constant

CH=heat of convection

EH=equivalent horsepower $T_W$=wall temperature $T_B$=gas temperature

L=tube length

From this calculation, it was determined that the heat transferred per time equivalent (power) to the helium is 286.53 HP, an efficiency of 97%.

What is claimed is:

1. An apparatus for evacuating gas from a chamber to reduce the pressure therein comprising:

a housing having a lower, downwardly facing wall and an upper, upwardly facing wall;

an inlet means disposed within said lower wall and comprising a first gas flow director of truncated conical shape having a larger open end facing downwardly and a smaller open end facing upwardly, in flow communication with said housing;

a plurality of stationary vanes disposed at the smaller open end of said first gas flow director, for imparting a vortex flow to gas flowing therethrough;

an outlet means disposed within said upper wall and comprising a second gas flow director of truncated conical shape and having a larger end facing downwardly and disposed within said housing and a smaller open end facing upwardly, external to said housing, said second gas flow director further comprising a circumferential surface portion disposed within said housing, said surface portion comprising outer and inner surfaces;

a means for closing the larger end of said second gas flow director, to prevent flow of gas therethrough;

a plurality of slits disposed longitudinally in the surface portion of said second gas flow director disposed within said housing, each said slit comprising a guide flap disposed on said outer surface and a guide flap disposed on said inner surface for guiding gas flow through said slit;

heating means disposed within said second gas flow director; and deflector means disposed within said housing adjacent said means for closing to direct gas flow away from said means for closing and towards the outer surface of said circumferential surface portion.

2. Apparatus according to claim 1, wherein said heating means comprises heat exchange means adapted for connection to a source of heated fluid.

3. Apparatus according to claim 1, wherein said plurality of stationary vanes comprises four vanes spaced at 90°.

4. Apparatus according to claim 1, wherein said plurality of slits comprises at least 20 slits equally spaced around said circumferential surface portion.

5. Apparatus according to claim 1, wherein said deflector is semi-spherical in shape.

6. A method for increasing the efficiency of evacuation of a gas of predetermined density from a chamber, comprising the steps of:

coupling to a housing at a lower wall thereof a first gas flow director of truncated conical shape having a larger end connected to a source of gas and a smaller end coupled to the lower wall of the housing, the housing being disposed for generally upward flow of said gas;

coupling to said housing at an upper wall thereof, opposite to the first gas flow director, a second gas flow director of truncated conical shape, with a larger end disposed within the housing comprising a circumferential surface portion, dividing the second gas flow director into outer and inner portions;

closing off the larger end of said second gas flow director and deflecting gas flow to said circumferential surface portion;

placing a plurality of longitudinal slits in said circumferential surface portion, each of said slits comprising a guide flap connected to said outer surface and a guide flap connected to said inner surface, and disposed for guiding gas flow through said slit;

directing gas flow from said source of gas through said first gas flow director and through a plurality of fixed vanes at the smaller end of said first gas flow director to impart to the gas flow a vortex motion;

heating gas flow within the second gas flow director to a temperature at least 16° C. above ambient, to cause gas to flow upwardly through said vanes and said slits, and outwardly from the smaller end of said second gas flow director.

7. A method according to claim 6, wherein the gas flow is heated to a temperature of at least 400° C.

* * * * *